United States Patent [19]

Schmidli

[11] Patent Number: 4,815,051

[45] Date of Patent: Mar. 21, 1989

[54] ANALOG ELECTRONIC WATCH THAT INDICATES THE DAY OF THE WEEK AND THE ORDINAL OF THE MONTH

[75] Inventor: Pierre Schmidli, Evilard, Switzerland

[73] Assignee: ETA SA Ebauches, Switzerland

[21] Appl. No.: 168,779

[22] Filed: Mar. 16, 1988

[30] Foreign Application Priority Data

Mar. 23, 1987 [CH] Switzerland ..... 1098/87

[51] Int. Cl.[4] ..... G04B 19/24; G04B 19/20

[52] U.S. Cl. ..... 368/37; 368/35

[58] Field of Search ..... 368/28, 31–38

[56] References Cited

U.S. PATENT DOCUMENTS

| | | | |
|---|---|---|---|
| 249,536 | 11/1881 | Lewis | 368/28 |
| 422,090 | 2/1890 | Miller | 368/28 |
| 3,452,535 | 7/1969 | Cabantous et al. | 58/4 |

FOREIGN PATENT DOCUMENTS

| | | |
|---|---|---|
| 2085753 | 12/1971 | France . |
| 322899 | 11/1958 | Switzerland . |
| 1590467 | 6/1981 | United Kingdom . |
| 1602034 | 11/1981 | United Kingdom . |

*Primary Examiner*—Bernard Roskoski

*Attorney, Agent, or Firm*—Pollock, Vande Sande & Priddy

[57] ABSTRACT

The watch includes a time-keeping circuit, a first motor, hands driven by the motor to display the time, an index that moves forward by 1/35th of a revolution per 24 hours, a stationary graduation having inscribed thereon 35 days of 5 consecutive weeks, a mobile graduation divided into 35 parts and bearing numbers 1 to 31 for the ordinals of the month, a second motor that drives the mobile graduation in steps of 1/35th of a revolution, a calendar circuit issuing a signal that is representative of the month and a signal that is representative of the year, and a correction circuit connected to the calendar circuit and issuing a control signal to the second motor. At the end of each month, the mobile graduation is moved by the second motor through N steps (N=4,5,6 or 7) such that number 1 thereon comes to lie opposite the index at the beginning of the following month. The two graduations provide the correspondence between the days of the week and the ordinals of the month for the current month whereas the index indicates the actual day of the week and ordinal of the month.

8 Claims, 2 Drawing Sheets

ANALOG ELECTRONIC WATCH THAT INDICATES THE DAY OF THE WEEK AND THE ORDINAL OF THE MONTH

FIELD OF THE INVENTION

This invention relates to an analog electronic watch with a perpetual calendar that indicates the day of the week and the day or ordinal of the month.

BACKGROUND OF THE INVENTION

Such watches are well known. They generally comprise, behind the dial, a disc bearing indications of the days of the week, and another disc on which are inscribed numbers 1 to 31 for the ordinals of the month. The two discs are driven by the watch's movement to display the indications designating the current ordinal of the month and the corresponding day of the week through an aperture that is formed in the dial.

Besides this information about the current day, it is often most useful to have the same information about a future day, for instance for the purpose of making an appointment. Present analog electronic watches, however, do not provide such an indication, which, on the other hand, is given by some mechanical calendar watches.

These mechanical watches have been known for a long time and comprise a stationary, ring-like graduation which is disposed on the dial and which is centered on the axis of the time-indicating hands. This graduation is divided into 35 equal parts and each part bears the indication of one day of the week for 5 consecutive weeks. Another graduation, which is also divided into 35 parts and which is both concentric with the preceding graduation and able to rotate about its center in response to manual actuation, has inscribed thereon numbers 1 to 31. Each number corresponds to an ordinal of the month and is inscribed, opposite a day of the week, in one of the 31 consecutive parts of the graduation which thus provides a free space extending over 4 days. These watches further comprise an indicator hand, or index, which is driven by the movement so as to travel 1/35th of a revolution in 24 hours around the axis of rotation of the other hands.

In these conditions, it suffices to place, at a given moment, the indicator hand on the correct day and move the graduation bearing the numbers to the position in which the corresponding day of the month is brought into alignment with this hand whereby the watch may continue to indicate indefinitely the days of the week, but only till the end of the current month, and the ordinals of the month. At the beginning of each month the graduation bearing the ordinals must then be moved, e.g., by 4 days if the past month was January, whereby the indicator hand may show the first of February.

Since both graduations are fully visible, it is possible in these watches to permantly read off the correspondence, for the current month, between the ordinals of the month and the days of the week.

A mechanical watch of this type is described in detail for instance in Swiss Specification No. 332899. In this particular form of construction, the graduation bearing the days of the week is on the dial while that indicating the ordinals of the month is disposed on a rotary glass. At the beginning of each month the glass must therefore be placed manually in the correct position. This operation of course amounts to a constraint that is incompatible with current trends towards simplified watch controls, in particular with electronic watches.

SUMMARY OF THE INVENTION

An object of the present invention is to provide an analog electronic watch that combines the advantages of both types of watches just mentioned, without their drawbacks.

The analog electronic watch provided by the invention comprises:

means for analogically displaying the time;

a stationary, ring-like graduated member bearing regularly spaced indications of the days of the week for at least five consecutive weeks;

a rotary index that is mechanically coupled to the time display means and which travels, over the stationary graduated member, in 24 hours, the distance separating one day from the next;

a mobile graduated member that is concentric with the stationary graduated member and which bears numbers 1 to 31 to indicate the ordinals of the month, said numbers being arranged in increasing numerical order such that two consecutive numbers will lie opposite two successive days on the stationary graduated member;

control means for moving the mobile graduated member;

a perpetual calendar circuit arranged to issue a calendar signal; and a correction circuit arranged to issue, in response to the calendar signal, a correction signal to the control means to move the mobile graduated member and to bring the number 1 it bears in line with the index as the watch passes from one month to the next.

The analog electronic watch according to the invention has the advantage of simultaneously indicating the ordinal of the month, the day of the week and the correspondence between the ordinals and the days of the week for the current month, without having to manually correct the calendar at the beginning of each month.

BRIEF DESCRIPTION OF THE DRAWINGS

In the accompanying drawings, given by way of example.

DETAILED DESCRIPTION OF THE PRESENT INVENTION

Figure 1:
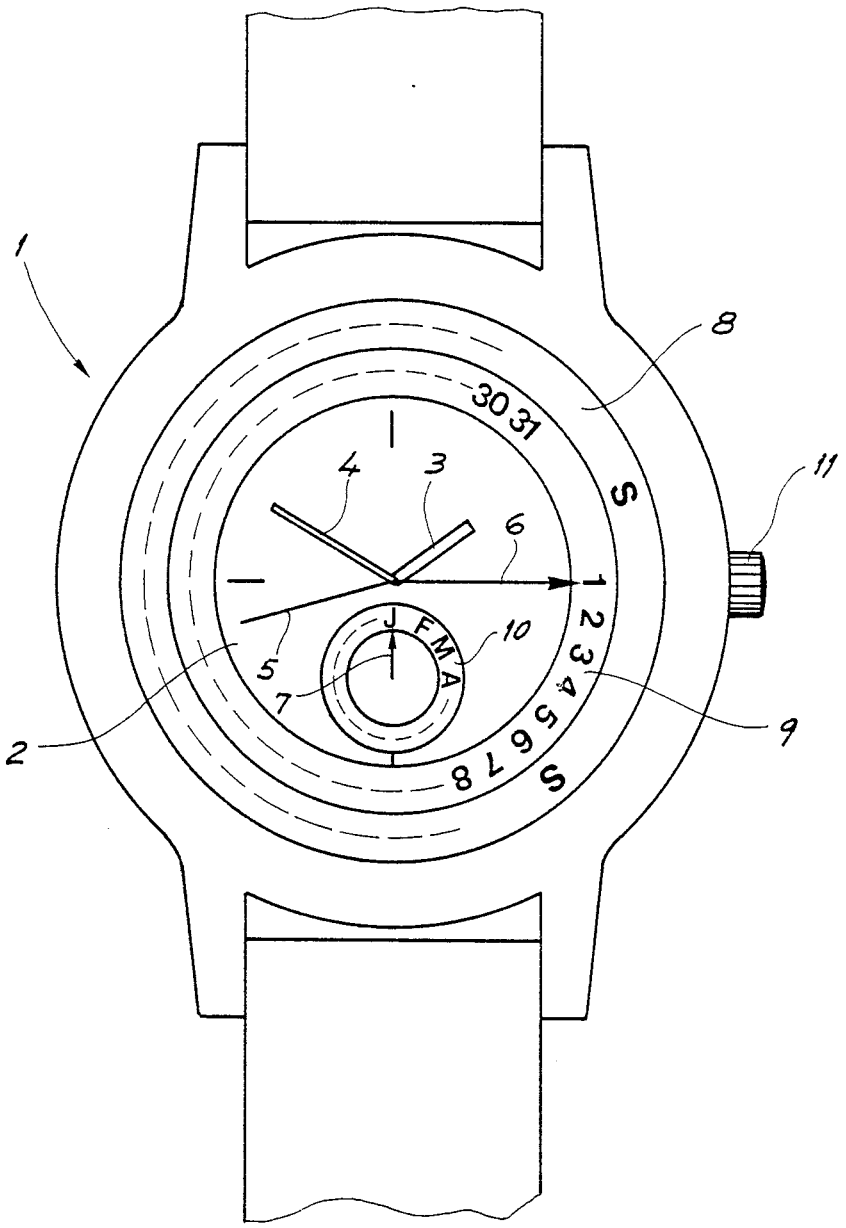
FIG. 1 is a plan view of one form of embodiment of the watch according to the invention.

The watch 1, shown in FIG. 1, comprises an analog time display consisting of a dial 2 and of hours, minutes and seconds hands 3, 4 and 5 respectively. The watch further comprises a hand indicator (index) 6 for indicating the ordinals of the month and the days of the week. Index 6 is kinematically coupled to the hours hand 3 to travel in a 24 hours period, either continuously or step-by-step at an angle corresponding to one 35th part of the circumference of the dial. All hands are driven by a motor about a common axis of rotation. The watch may advantageously also have a hand 7 for indicating the months that is driven around its own axis of rotation by an ad hoc motor.

On dial 2, besides hands 3 to 7, is also disposed a stationary graduation 8 that is divided into 35 equal parts, each part carrying the indication of a day of the week, i.e. Monday, Tuesday . . . , etc., for five consecutive weeks, i.e. 35 days in all, and a mobile graduation 9 which is borne by a disc that rotates about the same axis as hands 3, 4, 5 and 6. Graduation 9 is also divided into 35 equal parts, including 31 parts bearing numbers 1 to 31, which are inscribed in increasing order opposite, and in the same direction as, the succession of days of the week on graduation 8. In this arrangement, four consecutive parts of graduation 9 thus bear no indication. Moreover, a graduation 10, bearing indications for the twelve months of the year, is disposed around the rotational center of hand 7.

In these conditions, index 6, by pointing at a day of the week appearing on crown 8 and at a number corresponding to the ordinal of the month on crown 9, thus permanently gives the date, the month being indicated by hand 7 on dial 10. Of course, graduations 9 and 8 additionally enable the correspondence between the ordinal and the day of the week to be read for the whole of the current month. At the beginning of each month the disc bearing graduation 9 must be moved by a motor to move number 1 into line with index 6 so that the watch will carry on giving the right date.

Additionally, a crown 11, movable between a nuetral position 11' and a pulled-out position 11", enables the watch to be time set in a conventional manner.

The electronic movement of the watch shown in FIG. 1 thus comprises three motors, an electronic circuit for activating the motors and a cell for supplying the circuit.

Figure 2:
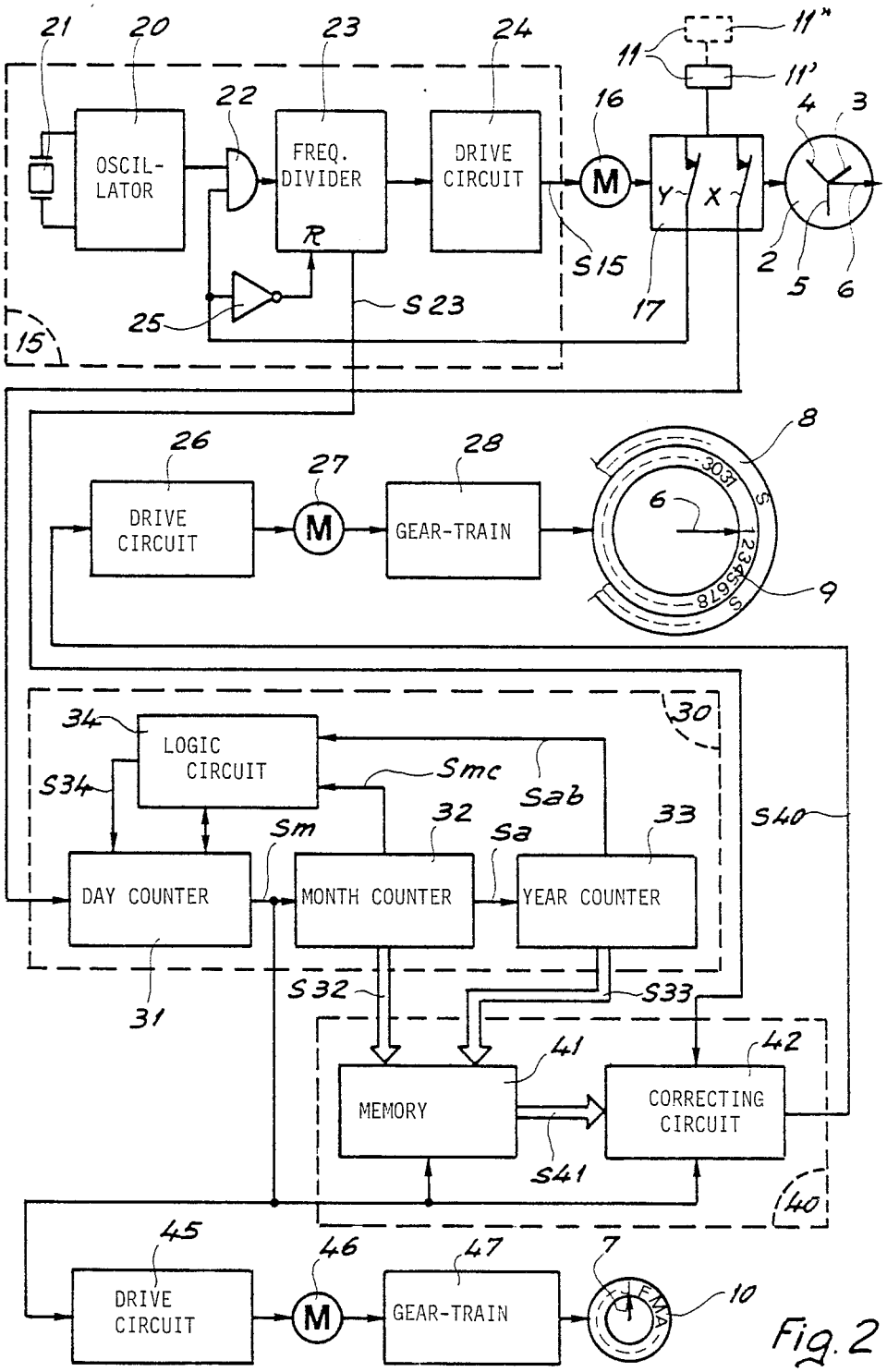
FIG. 2 illustrates a form of circuit for the watch shown in the preceding Figure.

The circuit shown in FIG. 2, without a cell, comprises a time-keeping circuit 15 that supplies a clock signal S15 to a first motor 16 which drives, via control mechanism 17, time-indicating hands 3, 4 and 5 and index 6.

Time-keeping circuit 15 includes an oscillator 20 that is frequency stabilized by a quartz resonator 21 issuing for instance a 32768 Hz signal, a two-input AND gate 22 with one input connected to the output of oscillator 20, a frequency divider 23 whose input is connected to the output of AND gate 22, and a drive circuit 24 which receives a 1 Hz signal from frequency divider 23 and issues signal S15 at its output. Frequency divider 23 further has an output issuing a retrieval signal S23 made up of short pulses and having a frequency of about 10 Hz, and a reset input R which is connected to the output of an inverter 25, the input of the latter being connected to the second input of AND gate 22.

First motor 16 is for instance of the unidirectional, stepping type. In control mechanism 17 it drives a first gear-train, not shown, that moves hands 3, 4, 5 and 6, described earlier, forward. This gear-train also actuates a first, daily, contact X, closing it as the watch passes from one day to the next, i.e. at midnight, to generate a daily logic signal Sx. It will be assumed that logic signal Sx is low when contact X is open, and is high when this contact is closed. The same rule will apply to all signals produced by contacts.

Control mechanism 17 further comprises correction means, not shown, for time-setting the watch by means of crown 11. When crown 11 is moved into correcting position 11" it then finds itself mechanically coupled with hands 3, 4, 5 and 6, enabling them to be moved to correct the time in conventional manner.

Crown 11 further acts, regardless of its angular position, on a second contact Y which generates a logic signal Sy that is applied to the second input of AND gate 22. Contact Y is closed when crown 11 is in neutral position 11' and open when crown 11 is in correcting position 11".

The elements just described, except index 6, form a conventional analog watch that operates as follows: When crown 11 is in neutral position 11', with signal Sy being high, AND gate 22 lets the signal from oscillator 20 proceed to frequency divider 23. The rest input R of frequency divider 23 being low, this circuit applies the 1 Hz signal to the input of drive circuit 24 which in turn applies clock signal S15 to first motor 16. Motor 16 drives, via first gear-train 17, time display hands 3, 4 and 5 and actuates, by means of the same gear-train, contact X. The daily signal Sx that is generated by contact X switches, at midnight, from low to high hand then returns, a little later, to low, so to remain low until the beginning of the next day.

In the correcting position 11" of crown 11, signal Sy is low, thus blocking AND gate 22 and resetting frequency divider 23 which then receives no signal. The same applies to motor 16, which remains idle. The hands may then only be moved by crown 11 which, in position 11", is linked up with gear-train 17 to enable an accurate time-setting of the watch. Of course, when the hands driven by crown 11 go through midnight, contact X is activated in the same way as when they are driven by first motor 16.

The watch further comprises a second drive circuit, 26, that is similar to circuit 24, a second unidirectional motor, 27, that is similar to motor 16 and that is connected to circuit 26, and a second gear-train 28 that is connected to motor 27. Second gear-train 28 drives, in a direction opposite to that of index 6, the disc bearing mobile graduation 9 through a step equal to 1/35th of a revolution, i.e. through an angle corresponding to the distance separating one ordinal from the next, in response to a pulse applied to the input of circuit 26. In these conditions, for index 6 to be pointing at 1 at the beginning of each month, circuit 26 must have received at the end of the previous month N correction pulses on its input.

Number N depends of course on the month but also, if the watch is required to remain in agreement with the indications of a perpetual calendar, on the year in a four year cycle. If A designates the years numbered 1 to 4 in a four year cycle, with 1 corresponding to the leap year, and if M designates the months numbered 1 to 12, with 1 corresponding to January, the value of N at the end of each month is given by the following table:

| | | | | | | | | | | | | | | | | |
|---|---|---|---|---|---|---|---|---|---|---|---|---|---|---|---|---|
| A: | 1 | 1 | 1 | 1 | 1 | 1 | 1 | 1 | 1 | 1 | 1 | 1 | 2 | 2 | 2 | 2 . . . |
| M: | 1 | 2 | 3 | 4 | 5 | 6 | 7 | 8 | 9 | 10 | 11 | 12 | 1 | 2 | 3 | 4 . . . |
| N: | 4 | 6 | 4 | 5 | 4 | 5 | 4 | 4 | 5 | 4 | 5 | 4 | 4 | 7 | 4 | 5 . . . |

This table, which only contains a leap year and the start of a normal year, shows in particular that N=6 at the end of month 2 (February) of year 1 (leap year), whereas N=7 at the end of the same month in a normal year.

The N pulses are contained in a correction signal generated by a circuit mainly comprising a perpetual calendar circuit 30 and a correction circuit 40 which will both now be described.

Perpetual calendar circuit 30 comprises a 5-bit day counter 31 counting by 31, a 4-bit month counter 32 counting by 12, and a 2-bit year counter 33 counting by 4. These counters are connected in series. Counter 31 receives on its input daily signal Sx, generated by contact X, and issues on its output a montly signal Sm as the watch passes from one month to the next. Signal Sm is applied to the input of counter 32 which issues, when the watch passes from one year to the next, a yearly signal Sa that is applied to the input of counter 33. On respective output of the month and year counters appear signal representative of their corresponding contents, referenced S32 for counter 32 and S33 for counter 33. Counter 32 additionally issues a signal Smc indicating short months, i.e. those with less than 31 days, and counter 33 issues a signal Sab indicating the leap year in a 4-year cycle.

Calendar circuit 30 further comprises a logic circuit 34 which produces from signals Smc and Sab a signal S34 for counter 31 so as to set its contents to 1 as the watch passes from a month of less than 31 days to the next month. In this way the contents of counter 31 will always agree with the perpetual calendar.

Signal Sm is produced when the contents of counter 31 is set to 1. It will be assumed that signal Sm is normally low and that it goes high at midnight at the end of a short month, then to revert to low at the latest the day after.

Circuit 30 will not be described in detail since such circuits are well-known. One such circuit is for example described with all the required detail in U.S. Pat. No. 4,300,222 which relates to an electronic watch having a perpetual analog calendar.

Correction circuit 40 produces, from signals S32 and S33, correction signal S40 for controlling the position of the disc that bears mobile graduation 9. Circuit 40 includes a read-only memory 41 and a conversion circuit 42, also called a Binary Rate Multiplier (BRM), both being well-known.

Memory 41 receives signals S32 and S33. Signal S32 is a 4-bit multiple logic signal able to assume twelve different states, each state corresponding to one month. And signal S33 is a 2-bit logic signal able to assume four different states, each state corresponding to one year of a 4-year cycle including a leap year.

Signals S32 and S33 define $12\times4=48$ addresses in memory 41, each address being made up of the numeral of a month and the numeral of a year in the 4-year cycle. To each address is allotted a number, this number being equal to the value of N as given in the above table in dependence on the months (M) and years (A).

Memory 41 moreover receives monthly signal Sm to read the value of N as the calendar passes from one month to the next. This value of N appears at the output of memory 41 in the form of a 3-bit multiple logic signal S41 able to assume four different states corresponding to numbers 4, 5, 6 and 7.

Signal S41 is applied to the input of circuit 42 which further receives retrieval signal S23 of about 10 Hz, and the monthly signal Sm. Circuit 42 issues at its output correction signal S40 which, normally, is low, except at the beginning of each month. At that moment, in response to signal Sm, correction signal S40 is made up of a train of N pulses, the value of N being determined by the logic state of signal S41. These pulses are obtained from signal S23, by letting through 4, 5, 6 or 7 consecutive pulses of this signal, and they thus enable mobile graduation 9 to be moved through 4, 5, 6 or 7 days into its correct position in less than one second.

The watch furthermore comprises a third drive circuit 45, a third motor 46 that is connected to circuit 45, and a third gear-train 47 that is controlled by motor 46 and moves month-indicating hand 7, whenever the month changes, in response to the monthly signal Sm that is applied to the input of circuit 45.

The watch may further comprise with advantage means, not shown, for selecting any past or future month and for moving graduation 9 to the position that corresponds to this month such that the correspondence between the ordinals of the month and the days of the week may be read, and means for automatically returning to the present month.

If the watch is initially time and date set, it need not again be corrected, except for small time corrections by means of crown 11.

To simplify calendar circuit 30, it could comprise only counters 31 and 32. The calendar of the watch would then be of the semi-perpetual type.

Of course, the above described watch could be modified in still other ways and be constructed in a variety of forms that will be obvious to the man of the art, within the framework of the present invention.

I claim:

1. An analog electronic watch comprising:

means for analogically displaying the time;

a stationary annular graduated member having regularly spaced indications of the days of the week for at least five consecutive weeks;

a rotary index mechanically coupled to said time display means traveling over said stationary graduated member, in 24 hours, the distance separating one day from the next;

a mobile graduated member positioned concentrically with respect to said stationary graduated member, said mobile graduated member having numbers 1 to 31 thereon to indicate the ordinals of the month, said numbers being arranged in increasing numerical order such that two consecutive numbers will lie opposite two consecutive days of the week on the stationary graduated member;

control means for moving said mobile graduated member;

a perpetual calendar circuit for outputting a calendar signal representative of the numeral of the month and the numeral of the year in a four-year cycle; and a correction circuit for outputting, in response to said calendar signal, a correction signal to said control means to move the mobile graduated member through N days to bring the number 1 it has thereon in line with the index as the watch passes from one month to the next.

2. A watch according to claim 1, wherein said correction circuit comprises:

a read-only memory for outputting, in response to said calendar circuit, a signal representative of said number N; and a conversion circuit for converting said number N signal to said correction signal.

3. A watch according to claim 1, wherein said correction signal comprises a pulse train appearing as the watch passes from one month to the next, said pulse train includng a number of pulses that is representative of the number N.

4. A watch according to claim 1, wherein N is:

4 at the end of the months of January, March, May, July, August, October and December;

5 at the end of the months of April, June, September and November;

6 at the end of the month of February in a leap year; and 7 at the end of the month of February in an ordinary year.

5. A watch according to claim 1 further comprising means connected to the calendar circuit to display the month analogically.

6. A watch according to claim 2, further comprising means connected to the calendar circuit to display the month analogically.

7. A watch according to claim 3, further comprising means connected to the calendar circuit to display the month analogically.

8. A watch according to claim 4, further comprising means connected to the calendar circuit to display the month analogically.

* * * * *